US006303073B1

(12) United States Patent
Malpohl

(10) Patent No.: US 6,303,073 B1
(45) Date of Patent: Oct. 16, 2001

(54) METERING OVEN

(75) Inventor: Klaus Malpohl, Solingen (DE)

(73) Assignee: W. Strikfeldt & Koch GmbH (DE)

( * ) Notice: Subject to any disclaimer, the term of this patent is extended or adjusted under 35 U.S.C. 154(b) by 0 days.

(21) Appl. No.: 09/297,992

(22) PCT Filed: Nov. 10, 1997

(86) PCT No.: PCT/DE97/02663

§ 371 Date: Jun. 25, 1999

§ 102(e) Date: Jun. 25, 1999

(87) PCT Pub. No.: WO98/20996

PCT Pub. Date: May 22, 1998

(30) Foreign Application Priority Data

Nov. 11, 1996 (DE) ..... 196 47 713

(51) Int. Cl.[7] ..... C21D 11/00
(52) U.S. Cl. ..... 266/89; 266/239
(58) Field of Search ..... 266/89, 239

(56) References Cited

U.S. PATENT DOCUMENTS 5,031,805 * 7/1991 Rothmann ..... 266/239
5,626,180 * 5/1997 Kahn et al. ..... 164/136

OTHER PUBLICATIONS

Patent Abstracts of Japan vol. 017, No 445 (P–1593) Aug. 1993.*

* cited by examiner

*Primary Examiner*—Scott Kastler
(74) *Attorney, Agent, or Firm*—Marshall & Melhorn, LLC

(57) ABSTRACT

The invention concerns a metering oven (1) with a vessel (12) for holding a liquid metal and with a device for detecting a liquid metal level in a vessel. A tubular probe (5) is connected to a gas source (10) for discharging a gas at a predetermined pressure from the gas source through the probe and out of its aperture. The probe is spatially associated in a fixed manner with the vessel such that pressures which can be detected by a pressure-measuring device (9) can be associated with different liquid metal levels inside the probe. At a given pressure threshold value, the pressure-measuring device can emit a signal for a given liquid metal level to be detected.

7 Claims, 1 Drawing Sheet

METERING OVEN

BACKGROUND OF THE INVENTION

1. Field of the Invention

The invention relates to a metering oven with a vessel for receiving liquid metal and a device for detecting a liquid metal level in a vessel.

2. Description of the Prior Art

For metering liquid metal from a metering oven, the height of the column of metal rising in the metering tube must be detected, since the metering amount is calculated on the basis of this detection. It is also possible, in dependence on the detection of the height of the metal column, to determine the height of the liquid level in the oven taking into account other parameters, for example different pressures. From U.S. Pat. No. 4,220,319 a sensor arrangement for metering ovens is known in which the sensor consists of a metal needle standing perpendicular or almost perpendicular to the metal surface, and which emits a signal on contact with the surface of the liquid metal. In order to reduce the wear on the sensor arrangement, the metal needle is swung away from the metal surface by an automatic mechanical system on contact. This known arrangement has various disadvantages; in particular the mechanical swivel system involves high outlay and is very expensive and, in spite of the swivelling, the wear on the metal needle is relatively high. The needle can first of all be decomposed by the contact with liquid aluminium on the basis of chemical processes. Moreover, the measuring result can be impaired by the accumulation of aluminium or aluminium oxide on the needle.

In practice, because of the above-explained wear of the metal needle, grinding, cleaning or exchange of the needle is necessary, such that the scanning position cannot be held over a lengthy period of time. Furthermore, there are no adjustment aids known in practice which make reproducible scanning possible. In particular, the scanning position in relation to the discharge edge of the metering tube is of particular importance in metering ovens. For metering which may be reproduced very well, the needle should detect exactly the discharge position of the liquid metal at the discharge edge of the metering tube (needle and discharge edge must sit at the same height). The detection, however is displaced in practice not only by the above-mentioned maintenance and repair work on the metal needle, but also through the exchange of the metering tube, whose installation height directly determines the position of the discharge edge. Determined by large production-engineering tolerances in the refractory sphere, the installation of a new metering tube as well as a new seal etc. can displace the discharge edge by up to 10 mm in vertical height.

On metering ovens, a displacement of the scanning position in relation to the discharge edge, as a result of the above-mentioned measures, of for example 5 mm causes an alteration in the metered metal weight of typically 4%. A metering accuracy of 1 to 2% is required. Because of the bad access and the heat which prevails in the scanning region, in practice the needle is not subsequently adjusted; instead, the pressure or time parameters of the metering, or in our case the metering weight, which is determined in known manner according to the integral method (pressure over time), are changed in order to compensate for the distortion in the metering weight. This has the disadvantage that founders who have stored the metering parameters of various castings have to undertake corrections to these stored values again and again, since the scanning conditions and thus the metering do not in fact remain constant.

A further disadvantage of the metal needle portrayed above arises from the underlying principle (on account of the necessary contact with liquid molten metal). A layer forming after the shortest time on the surface of the molten metal, for example of non-conductive aluminium oxide, must first be broken through by the needle. As a result of the pressure of the needle, bulging of the metal surface downwards occurs. This causes, on the one hand, an inaccurate measurement result (the needle, after breaking through in a position which is too deep, emits its signal, i.e. less molten metal is indicated than is actually present). Moreover, after the oxide surface has been broken through, there is unnecessarily deep plunging of the needle into the liquid molten metal, such that the wear of the metal needle described above is accelerated.

From DE-OS 44 20 712 is known, furthermore, a sensor arrangement for detecting the level of liquid metal, in which arrangement the sensor consists of electrically-conductive ceramics and is inserted flush into the wall of the vessel or of an ascending pipe.

JP-A-05099726 is regarded as the definitive state of the art. It discloses a pipe which is disposed in the wall of the tundish filled with molten metal and is open towards the interior of the tundish, the pipe opening being disposed below the upper edge of the liquid molten metal. Gas is blown out of the pipe into the molten metal. The counter pressure generated in the pipe by the molten metal (trhough which pressure the filling height of the molten metal can be inferred) is detected by means of a pressure measuring device.

To measure an exact filling height, which would meet the requirements of a metering oven, an expensive pressure measuring device would be needed here however, and this device would, moreover, need to be constantly calibrated involving high outlay.

The problem underlying the invention is to create a metering oven with a vessel for receiving liquid metal and a device for detecting a level of liquid metal in a vessel, in which the device detects the level with high accuracy.

SUMMARY OF THE INVENTION

Owing to the fact that the pressure measuring device is realised as a pressure wave switch to detect a pressure resonse wave occurring within the probe when the probe opening is closed, and to emit a corresponding signal, and that the probe is securely inserted into the wall of an ascending pipe provided in the vessel, a simple device for detecting the level of liquid metal is made available which is low-cost and nevertheless detects a specific level with good reliability.

In contrast to the methods mentioned initially which are based on electrical contact, on the present invention for example no earthing is necessary. The wear-free and securely installed scanning system, based on indirect measurement by means of a gas (the "interposition" of the gas minimized the direct contact between probe and molten metal, moreover thin accumulations on the probe do not have any noticeable effect on the flow conditions of the gas), has moreover the advantage that the scanning conditions remain constant. On the one hand the height of the scanning position of the ceramic tube does not alter (securely installed), nor on the other hand does its position relative to the discharge edge (securely installed). This means the scanning conditions remain constant even if the metering tube is sometimes installed higher or lower in the metering oven. Moreover a distortion of the measurement values through an alteration in electrical conductivity occurring over the course of time (as for example in the above-mentioned sensor made of electrically-conductive ceramics) is excluded.

The tube or the probe can be securely inserted into the wall or the ascending pipe of a metering oven, the desired signal being emitted when the liquid level in the ascending pipe is passed.

The probe preferably consists of ceramics and this leads to the possibility of metal deposits on the probe being minimized (especially with the material pairing of ceramics and aluminium). Should, however, thin accumulations occur (for example because of the roughness of the probe), this does not lead to any impairment of function with the probe according to the invention, while on measuring systems which are based on electrical contact, even thin accumulations can cause a complete breakdown.

It is particularly advantageous to provide the probe produced from ceramics with an inner diameter of less than 2 mm. On account of the surface tensions which occur, for example of the liquid aluminium on the ceramics, the probe is not then blocked by liquid aluminium (even if there is no gas flow).

A further advantageous embodiment provides for the pressure measuring device to have a pressure wave switch, which may be adjusted in pressure sensitivity, for measuring a pressure response wave in the gas streaming from the probe. The pressure response wave, which is produced when the probe reaches (or is blocked by) a level of liquid metal, is for example used as a signal for closing a supply valve in the metering oven. The adjustability of the pressure wave switch makes possible simple adaptation, even during operation, to the conditions of the respective fitting location.

An advantageous development provides for the metering oven to contain a plurality of devices for detecting a liquid metal level, which each have a probe with an outlet aperture. If these outlet apertures lie beside one another (in relation to a static level of the liquid metal), in the case of a moving surface of the liquid metal, the level may be detected by appropriate averaging of the pressures measured in the probes; if these outlet apertures lie the one above the other, detection of the level is possible within wide limits.

An embodiment of the invention, given by way of example, is shown in the drawing and is explained in detail in the following description.

DESCRIPTION OF THE PREFERRED EMBODIMENT

Figure 1:
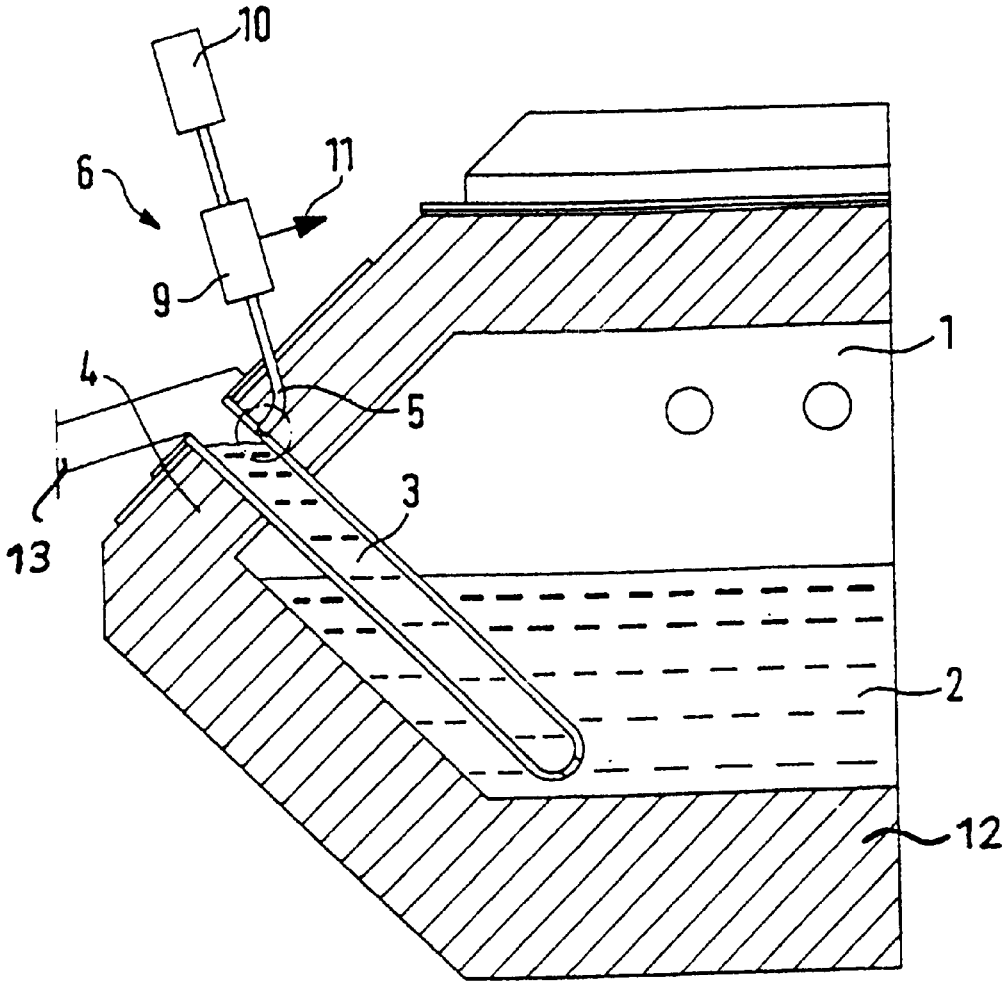
FIG. 1 shows schematically a section through a metering oven with ascending pipe.

FIG. 1 shows a metering oven 1 with a vessel 12, in which liquid metal, for example aluminium, is received in a bath 2. An ascending pipe 3 is inserted into the metering oven 1 and is led through the wall 4 of the metering oven 1 to the outside. Liquid metal is metered out via the ascending pipe 3. This can come about for example (according to a sensor device) through the controlled application of pressure in the interior of the vessel 12, in order to drive liquid metal through the ascending pipe 3 into a discharge pipe 13. The discharge pipe 13 fills the molten metal, preferably aluminium, for example into casting molds provided for this purpose. It is here important that the amount of molten metal driven out of the vessel 12 is matched to the volume of the casting molds. For metering it is necessary for the height of the column of metal in the metering oven (or in the ascending pipe 3) to be detected exactly, a pneumatic sensor 6 being used for this detection.

Figure 2:
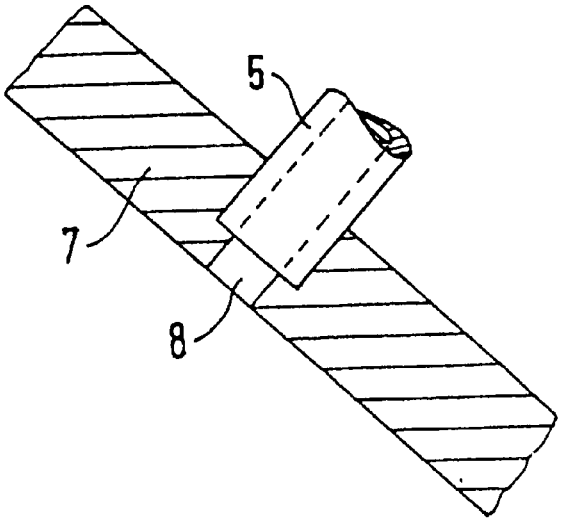
FIG. 2 shows an enlarged partial view of the end of the tubular probe inserted into the wall of the ascending pipe.

The pneumatic sensor device has a tubular probe 5 which preferably consists of ceramics, and which is inserted as per FIG. 2 into the wall 7 of ascending pipe 3. For this purpose, there is provided for example in wall 7 a bore 8, configured as a stepped bore, the end of the probe 5 in the bore portion with the larger diameter being pressed and/or glued from outside into the ascending pipe wall 7, and the smaller diameter of the stepped bore 8 corresponding approximately to the inner diameter of the pipe 5. The probe 5 is connected via a pressure measuring device 9 to a gas source 10. The gas source supplies gas at a specific pressure to the probe 5, which streams out of its front end and through the bore 8. When the level of metal in the ascending pipe approaches the end of the probe, the flow conditions at the end of the probe alter and a pressure change occurs in the probe. This pressure change is determined by the pressure measuring device 9. This then is an indirect method of measuring the level, since the filling level does not have to occur directly (for example via contact with a contact element provided for this purpose). Instead of this, the influence of a metal level, which is to be measured, on specific flow conditions (of a gas which flows from a gas source at a defined pressure) is ascertained. This influence can be determined in the probe 5 via a pressure change in the gas flowing out. Via this pressure change, information on the level of the liquid metal is thus possible. A pressure change which can be measured particularly clearly occurs if the open end of the probe 5 (or the bore 8) is obstructed by the liquid metal.

In order to detect the level of the liquid metal exactly, the pressure curve is measured, before the actual measurements, as the level is approached or rises, and a pressure threshold value is determined at which the level has a pre-determined association with the end of the probe 5. The pressure measuring device 9 then emits a corresponding signal at its exit 11 to the other evaluation control/regulating devices.

Any measuring device for measuring the pressure in the pipe 5 is suitable as the pressure measuring device 9. For example, a bridge circuit can be used, in which two throttles of solid diameter are connected in parallel to the gas supply 10. The exit of the first throttle is connected to a throttle of variable cross-section and the exit of the second throttle to the probe 5. Between the exits of the first and second throttles of fixed cross-section, a measuring flask is arranged which alters its position in response to pressure fluctuations. By adjusting the alterable throttles, the measuring device can be so balanced that the pressure is substantially against the measuring flask on both sides. If the flow conditions at the tip of the probe 5, i.e. at the bore 8, change as a result of the approach or passing of the metal level, the position of the measuring flask alters, by which means information about the existing pressure can be given. The position of the measuring flask can for example be detected via a reed contact.

In another embodiment, a so-called pressure wave switch is used whose adjustment range lies approximately between 0.5 and 5 mbar. These switches have on the inside a membrane to which a contact is applied. The one side of the membrane is connected to the ambient pressure, the other side is connected to the scanning tube or probe 5. If the scanning tube 5 is obstructed by a liquid, the pressure in the scanning tube 5 and thus on one side of the membrane rises and the lather is pressed against a fixed contact, such that the contact on the membrane comes into contact with the fixed one. By this means a flow of current is made possible when the pressure response threshold is reached.

The adjustment of the pressure sensitivity occurs simply through the adjustment of the spacing between the fixed contact and the membrane with the aid of a screw which is provided with a scale. According to the position of the screw, the fixed contact is at a greater or lesser distance from the membrane contact, such that also more or less pressure has to be applied in order to bring both contacts into contact with each other.

Since, for example during a metering process from the vessel 12 or ascending pipe 3 and the discharge pipe 13 into a casting mold, the bore 8 or the probe 5 can become blocked, protection against blocking of these openings is to be provided. This is given first of all by a dynamic pressure caused by the gas source, which, when the bore 8 is closed, ensures that the probe does not overflow with molten metal. Moreover, with an appropriate choice of the materials of the probe or of the constructional components surrounding or including same (ascending pipe, a section of the wall of the vessel) the accumulation of molten metal can be largely prevented. With the choice according to the invention of an inner diameter of the probe 5, or of the bore realized as a connection bore 8, of below 2 mm, and with an appropriate pairing of material (ceramics for the parts of the probe 5 coming into contact with the molten metal, and of the component containing the connection bore 8, in this case the ascending pipe 3), blocking by molten metal is made difficult. On the basis of the surface tensions which occur with specific material pairings, for example between ceramics and liquid aluminium, here blocking is even excluded. This is of critical importance for the present invention, particularly when taking as a basis the fact that, for example in the casting mold, even the smallest cavities are filled with molten metal.

In another embodiment of the present invention, a plurality of devices for detecting a liquid metal level can be provided in a single metering oven. Each of these devices has respectively its own probe with an outlet aperture. If these outlet apertures lie beside one another (for example in respect of a static level o the liquid metal), in the case of a moving surface of the liquid metal (for example during the process of filling into the metering oven) the level may be detected by appropriate averaging. Thus all possible false measurements as a result of a moving metal level are largely excluded. However, it is also possible to dispose the above-mentioned outlet apertures the one above the other, in order thus to make possible the detection of the level within wide limits.

What is claimed is:

1. Metering oven (1) with a vessel (12) for receiving liquid metal and a device for detecting a level of liquid metal in a vessel, a tubular probe (5) being connected to a gas source (10) for discharging a gas from the gas source through the probe and out of its outlet aperture, and a pressure measuring device (9) being provided for detecting a state of pressure inside the probe (5) in dependence on a counter-pressure caused by a level of the liquid metal, wherein the pressure measuring device (9) is a pressure wave switch for detecting a pressure response occurring inside the probe (5) when the probe opening is blocked by liquid metal and to emit a corresponding signal, and in that the probe (5) is securely inserted into the wall of an ascending pipe (3) provided in the vessel (12).

2. Metering oven according to claim 1, wherein the probe or the ascending pipe (3) consist of ceramics or substantially of ceramics.

3. Metering oven according to claim 1, wherein the probe (5) is pressed or glued into a bore (8).

4. Metering oven according to claim 3, wherein the outlet aperture of the probe (5) or the bore (8) has an inner diameter of less than 5 mm.

5. Metering oven according to claim 1, wherein the pressure wave switch may be adjusted in pressure sensitivity.

6. Metering oven according to claim 1, wherein a first and a second device for detecting a level of liquid metal are provided, which have a first and a second probe with a first and a second outlet aperture.

7. Metering oven according to claim 6, wherein the first outlet aperture lies, with respect to a static level of the liquid metal, above or near the second outlet aperture.

* * * * *